United States Patent [19]

Genovese et al.

[11] Patent Number: 4,974,830

[45] Date of Patent: Dec. 4, 1990

[54] CONTINUOUS PASSIVE MOTION DEVICE

[75] Inventors: Carmen E. Genovese; Ronald L. Lawrence, both of San Diego County, Calif.

[73] Assignee: Sutter Corporation, San Diego, Calif.

[21] Appl. No.: 308,735

[22] Filed: Feb. 9, 1989

Related U.S. Application Data

[63] Continuation of Ser. No. 299,712, Jan. 19, 1989, abandoned.

[51] Int. Cl.[5] ..... A61H 1/02

[52] U.S. Cl. ..... 272/25 R; 74/109

[58] Field of Search ..... 128/25 R, 25 B, 87 R, 128/88, 26; 272/900, 96, 145; 269/328; 74/109

[56] References Cited

U.S. PATENT DOCUMENTS

| | | | |
|---|---|---|---|
| 899,796 | 9/1908 | Osmer | 74/109 |
| 2,119,325 | 5/1938 | Godhart | 128/88 |
| 2,183,265 | 12/1939 | Maloney | 128/25 R |
| 3,058,459 | 10/1962 | Wyatt | 128/25 R |
| 4,487,199 | 12/1984 | Saringer | 128/25 R |
| 4,665,899 | 5/1987 | Farris et al. | 128/25 R |
| 4,756,204 | 7/1988 | Wittwer et al. | 74/109 X |
| 4,776,587 | 10/1988 | Carlson et al. | 272/145 X |
| 4,834,073 | 5/1989 | Bledsoe et al. | 128/25 R X |

*Primary Examiner*—Richard J. Apley
*Assistant Examiner*—H. N. Flaxman
*Attorney, Agent, or Firm*—Nydegger & Harshman

[57] ABSTRACT

A CPM device is disclosed having a single drive tube supporting the calf and thigh support members. Arms extend upwardly from the calf and thigh support members, each supporting an adjustable cradle in which the calf or thigh rests. The support arms are rotatable 180 degrees so that either leg may be supported over the single drive tube. A foot support is also cantilevered from the end of the calf support drive bar. The drive tube which supports the calf and thigh drive support bars is cantilevered from a unique support mechanism which attaches an end of the drive tube to the horizontal bed frame at the end of the hospital bed. A rack and pinion mechanism is combined with a unique gas spring in order to allow the drive tube to be easily rotated up above the hospital bed with the gas spring providing a power assist to the person lifting the drive tube off the bed in order that the drive tube may be easily rotated up off the bed without undue physical exertion.

20 Claims, 8 Drawing Sheets

CONTINUOUS PASSIVE MOTION DEVICE

CROSS REFERENCE TO RELATED APPLICATIONS

This application is a continuation of U.S. patent application Ser. No. 299,712, filed Jan. 19, 1989, now abandoned.

FIELD OF THE INVENTION

The present invention relates generally to rehabilitation devices for the lower leg, and more particularly to a rehabilitation device to restore knee motion, hip motion or ankle motion after trauma or surgery to the lower extremity.

BACKGROUND OF THE INVENTION

The first reported work with continuous passive motion devices for rehabilitation of joint cartilage defects was provided by Dr. Vernon Nichol of San Diego, Calif. and Dr. Robert Salter of Toronto, Canada. Their studies demonstrated a notable change in the status of articular cartilage under the influence of CPM as compared to an immobilized group. Following their reports, Dr. Richard Coutts of San Diego, Calif. applied their concepts to the post-operative patient, specifically for the rehabilitation of total knee patients. It was demonstrated in a small series of patients in his reported work that CPMs significantly aided the patient in regaining range of motion. Follow-up studies concluded that the total knee patient who received continuous passive motion therapy had a more rapid recovery of range, as well as improved comfort, wound healing, and venus dynamics.

With the rapid increase in application of CPM devices for an ever-expanding list of clinical indications, there has been a commensurate development of the technology. Two basic approaches have been utilized in designing a CPM device. In one, the anatomical approach, the joint is support and mobilized in a manner as similar to natural anatomic motion as is technologically possible. In the free linkage approach, motion is provided to adjacent anatomy, and the joint is allowed to seek its own anatomical motion. Anatomical design apparently offers more patient comfort, while free linkage design tends to be easier to use. The anatomical design is also believed by many to be safer to use on sensitive ligament repairs of the knee.

The continuous passive motion devices developed in the past have, in general, included a base or frame, a femur support which supports the upper part of the leg, a tibia support which supports the lower part of the leg, a foot support for supporting the foot, and a drive system. The femur and tibia supports are pivoted with respect to each other, and are supported above the frame. Examples of this type of device are show, for example, in Pisho, U.S. Pat. No. 4,323,060; Burner, U.S. Pat. No. 4,566,440; Griner, U.S. Pat. No. 4,558,692; Zigorsky, U.S. Pat. No. 4,549,534; and Genovese, U.S. patent application Ser. No. 925,473, filed Oct. 31, 1986 and its predecessor applications assigned to the assignee of the present application.

These devices presented a number of problems which needed to be addressed. Typically, the device as shown in the prior art are relatively heavy. Thus, for the patient in a hospital bed, when it is necessary to change the bed linens, it is very heavy and difficult to move out of the way. Further, such devices were difficult to adapt for use by either the left or right leg of a patient. The design of such devices made it difficult to provide continuous application of forces to the knee joint to provide proper rotation of the knee joint, and thereby the desired rehabilitation of the joint.

SUMMARY OF THE INVENTION

It is an objective of the present invention to provide an improved continuous passive motion device which overcomes many of the restrictions of known prior art devices.

More particularly, it is an objective of this invention to provide a continuous passive motion device which is so mounted to the hospital bed frame that it can be easily moved out of the way when the bedsheets are to be changed.

A further objective of the present invention is to provide a CPM device which is so designed as to provide continuous, even application of power to the knee joint in order to provide flexing of the joint in response to movement of the CPM device.

A further objective of the present invention is to provide a continuous passive motion device which is easily adaptable to support either leg of a patient for continuous passive motion rehabilitation therapy.

These and other objectives of the present invention are achieved in a CPM device having a single drive tube supporting the calf and thigh support members. Arms extend upwardly from the calf and thigh support members, each supporting an adjustable cradle in which the calf or thigh rests. The support arms are rotatable 180° so that either leg may be supported over the single drive tube.

A foot support is also cantilevered from the end of the calf support drive bar.

The drive tube which supports the calf and thigh drive support bars is cantilevered from a unique support mechanism which attaches an end of the drive tube to the horizontal bed frame at the end of the hospital bed. A rack and pinion mechanism is combined with a unique gas spring in order to allow the drive tube to be easily rotated up above the hospital bed with the gas spring providing a power assist to the person lifting the drive tube off the bed in order that the drive tube may be easily rotated up off the bed without undue physical exertion.

Further features and advantages of the present invention, as well as the structure and operation of the present device, can be fully understood from the following disclosure given with respect to the appended drawings.

DETAILED DESCRIPTION OF A PREFERRED EMBODIMENT

Figure 1:
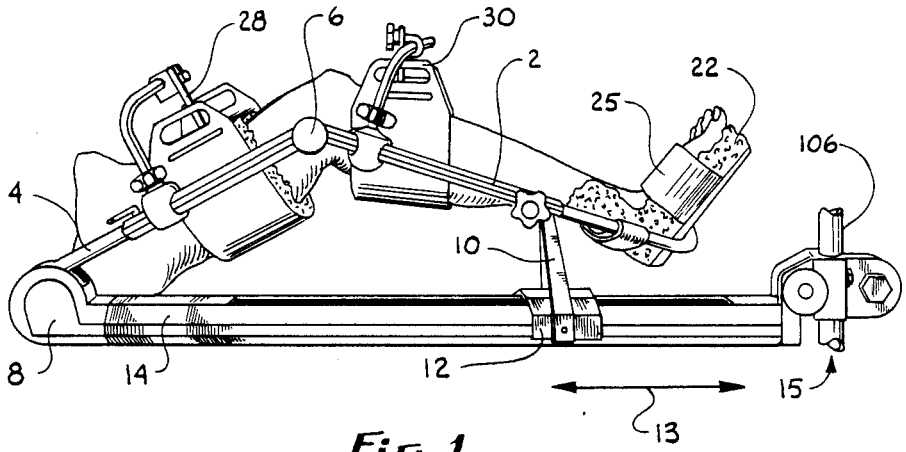
FIG. 1 is a side elevational view of the CPM device of the present invention.

Referring now to the drawings, FIG. 1 shows a CPM device with a patient's leg shown in phantom lines supported in the device. The device described herein comprises a calf support bar 2 and thigh support bar 4 connected at a hinged knee pivot section 6 which will be explained in detail with reference to FIG. 7.

One end of the thigh support bar 4 is connected at a hip pivot 8 intended to be placed adjacent the patient's hip as illustrated in FIG. 1. The hip pivot mechanism is shown in detail in FIG. 5B. The end of the calf support bar 2 distal from hip pivot 8 is supported on a yoke 10 which is connected by a trolley 12 to drive means (which will be explained with reference to FIG. 4A) incorporated within the drive tube 14.

Figure 4B:
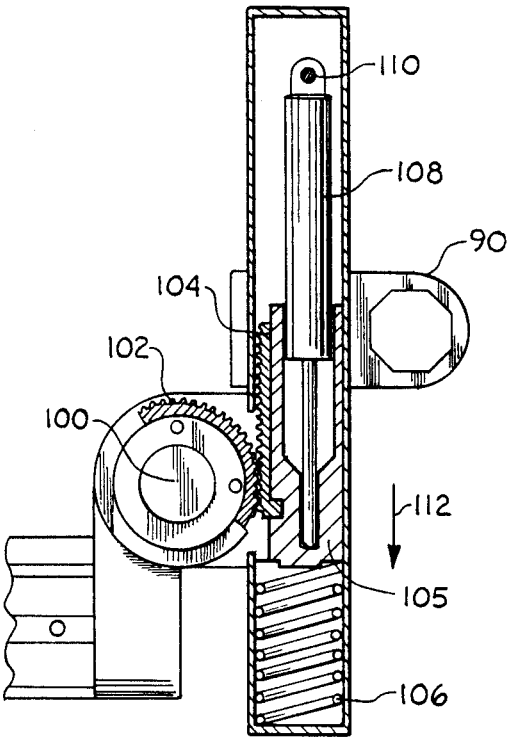
FIG. 4B is a detailed sectional view of the portion of the CPM device attached to the bed frame.
Figure 4A:
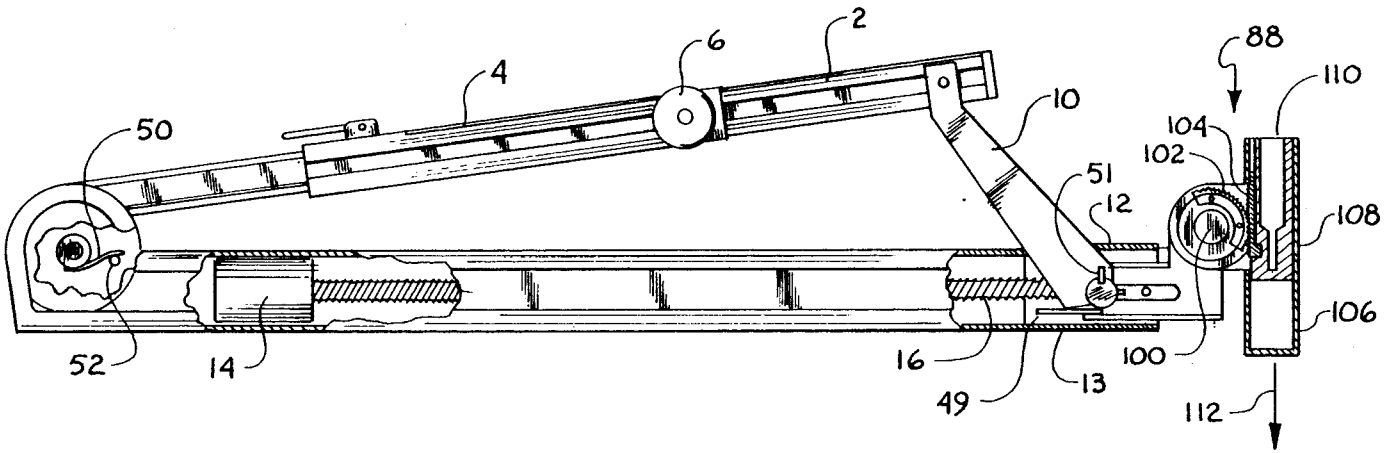
FIG. 4A is a side elevational view, partially in section, of the present invention.

The trolley 12 drives yoke 10 in reciprocating fashion along drive tube 14 in the directions indicated by arrow 13. As the yoke moves back toward hip pivot 8, the patient's knee resting above pivot 6 is flexed at a sharp angle. The yoke 10 then moves toward the traction frame supported end 15 drive tube, extending the patient's leg until the leg is fully extended as shown in FIG. 4A. The patient's knee is thus constantly exercised and rehabilitated. The design of the CPM device of the present invention must overcome a number of problems. The CPM device must be easy to use, as it is used by personnel unfamiliar with sophisticated mechanical devices. Considerable motive power must be applied through the yoke to the calf support bar to flex and extend the patient's knee. The patient's leg hangs to the side of the calf and thigh support arms 4, 2, applying significant torsional stress to these arms. The CPM must be movable off the hospital bed so that the patient can get on and off the bed, and the bed can be changed.

The following will explain how these and other design issues were addressed in the design of the present invention, beginning with an explanation of how the patient's leg is supported on the CPM device.

Figure 2:
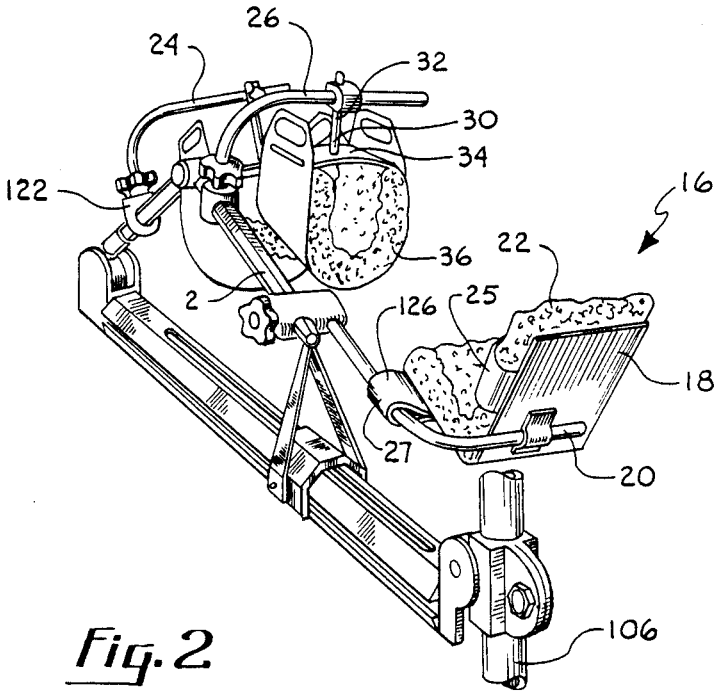
FIG. 2 is a perspective view of the CPM device of this invention.

As can be seen more clearly in FIG. 2, the end of the calf support bar 2 carries a foot support generally indicated at 16 which include a foot support plate 18 carried on an "L" tube frame 20. A soft boot 22 which is included in the patient kit which is supplied individually for each patient is wrapped around the foot support plate and the patient's foot as shown in FIG. 1. This foot support boot 22 may include a pocket on the rear surface thereof which slips over the top of the foot support plate 18 to aid in maintaining the foot support boot 22 in position. Two straps are also provided, one of which 25 wraps around the top of the patient's foot to hold it in the foot support boot.

Figure 8A:
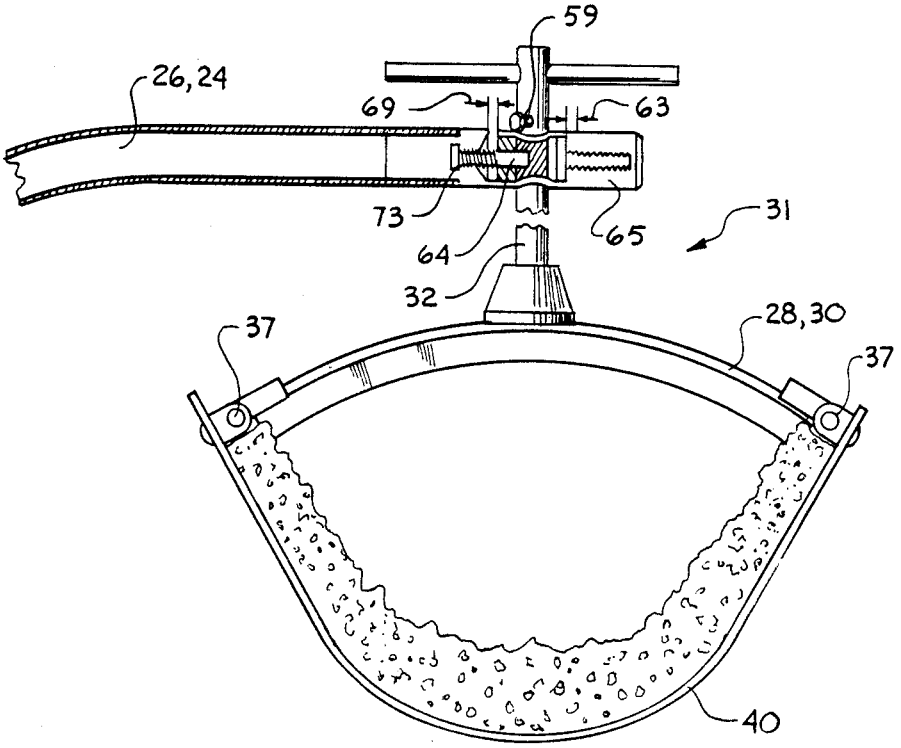
FIGS. 8A–8C are detailed views of the arm stirrup and patient kit for supporting the patient's leg in the CPM device.
Figure 8B:
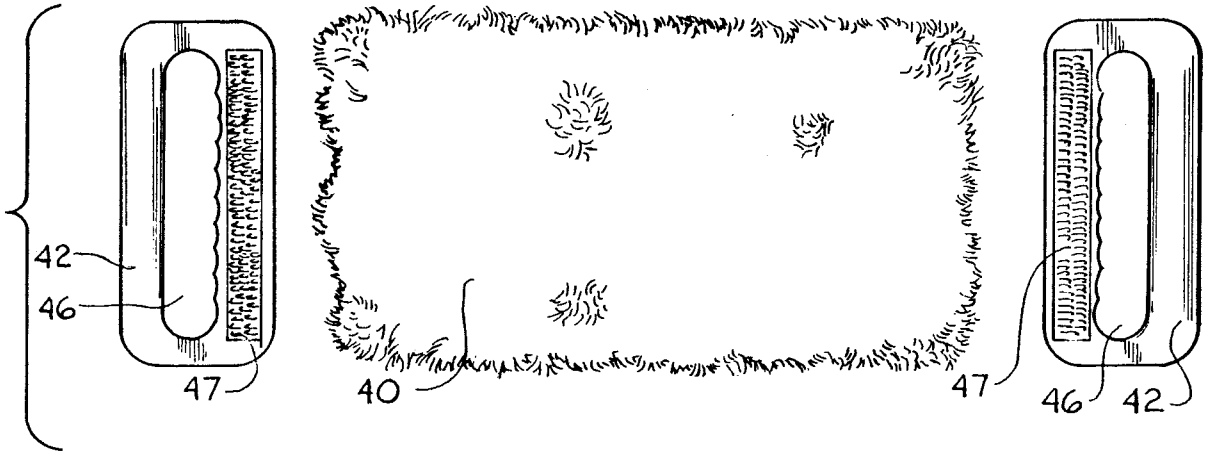
Figure 8C:
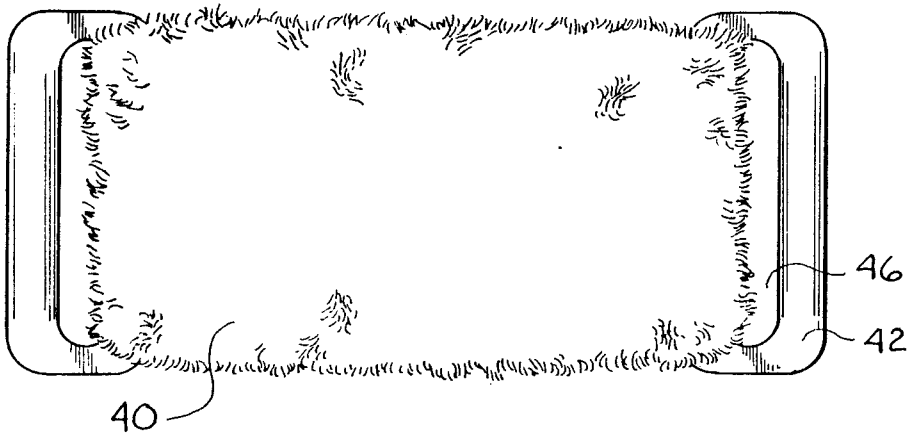

The patient's calf and thigh are supported from the appropriate calf and thigh supports 24, 26 which comprise L-shaped bars connected at one end to the calf and thigh drive arms 2, 4. Each L-shaped support bar 24, 26 supports a saddle 28, 30 which is a T-shaped metal frame 31 including a vertical element 32 as shown in greater detail in FIG 8A. The ends 37 of the saddle 28, 30 are designed to capture the openings 46 in the patient support element 40. This patient support element 40 which is shown more clearly in FIGS. 8B and 8C includes a soft central portion 40 of sheepskin or the like on which the patient's calf or thigh rests, and the attachment handles at each end 42. To mount the patient's leg from the saddle, it is only necessary to rest the leg on support 36, and using the handles 42, lift the leg into position and snap the ends of the patient handles 42 over the ends 37 of the saddle 28, 30. In order to provide a clean patient support element for each patient, the central sheepskin portion 40 is detachable from the handles 42. The handles 42 include velcro strips 47 on the edge thereof, these strips mating with complementary material on the back of the sheepskin so that the handles can be used to lift the patient's leg up onto the saddle.

A further and significant advantage of this approach to supporting the patient's leg from the CPM device, is that the use of the saddles to hold the patient kit allows us to push down on the leg from the top when the calf and thigh drive arms are descending. All previous devices have supported the leg from underneath. When the CPM device supports the leg from underneath, and the calf and thigh drive arms are moving away, eventually they may cease to pull the leg down, and a severely restricted case of knee motion will simply drop out from under the knee. In contrast, in this device, what happens is that the saddles push down on the leg from on top, and apply constant pressure to help break loose the cartilage and tissue that have formed around the knee and prevent its free movement.

It is also possible, following the design of the present invention, to easily change the height at which the patient's leg is supported relative to the L-shaped tube 24 or 26. This is achieved by making the upright rod 32 vertically adjustable relative to the attachment end of the L-shaped tube 24, 26. A plurality of slots 59 are cut in the side of the vertical element 32, and a spring-loaded pin 61 is inserted in one of the slots. The pin is carried at the end of a body 63, and a handle 65 is threaded on a rod 67 at the opposite end of the body from the pin 61. To change the height of the vertical support rod 32 relative to the L-shaped tube 24, 26, the handle 67 is unscrewed, creating a space indicated by the arrows 69. This space need only be greater than the length of the end portion of pin 61 which is inserted in the slot 59. By then using the handle to push the handle 65 to push on the body 63 against the force of the spring 73, the pin is effectively withdrawn from the slot 59, and the vertical support element 32 can be moved up or down to the desired height, whereupon the pin 61 is reinserted in the selected height 59 to hold the vertical element 32 in place.

As is well known in the use of these CPM devices, the rehabilitation effect is provided by driving the calf support 2 and thigh support 4 back and forth relative to one another causing flexing of the knee at the joint 6. In the device, the motion is established by movement of the yoke 10 and the motor 14, which is shown in FIG. 4A, so that the knee of the patient is first fully flexed as shown at 6 in FIG. 1, and is then fully extended, as would occur when the calf and thigh drive arms 2, 4 reach the position shown in FIG. 4A. Movement of the yoke is achieved by providing a motor 14 within the drive tube, connected through a drive screw arrangement 16 to a drive block 49 within the drive tube 14 attached to the trolley 12 of yoke 10. The drive power is transmitted from the drive block 49 to the trolley 12, which surrounds the top of the drive tube as is shown more clearly in FIG 5A. The drive block 49 is connected through pins or screws 51 directly to the bottom of the trolley. As the lead screw 16 turns, the drive block moves from its position, indicated by the letter A, where the calf and thigh bars 2, 4 would be fully flexed relative to one another, to the position B near the end of the path of travel where the yoke 10, calf bar 2 and thigh bar 4 would occupy positions substantially as shown in FIG. 4A. It is also apparent that as the trolley 12 moves back and forth over the surface of the drive tube 14, that considerable torsional effects are exerted on the yoke 10, because of the fact that the patient's leg is on one side or the other of the yoke, drive tube, and leg supports. Therefore, each end of the trolley 12 terminates in a bearings 53L and 53R shown in FIG. 5A which slides in the slots 55L and 55R on either side of the drive tube 14. Therefore, if the patient's leg is resting to the left of the drive tube illustrated in FIG. 5A, then the bearing will slide in the top of the right slot 55R, and on the bottom of the left slot 55L. In this way, proper alignment of the trolley with the drive tube is maintained throughout the path of motion of the trolley.

Figure 5A:
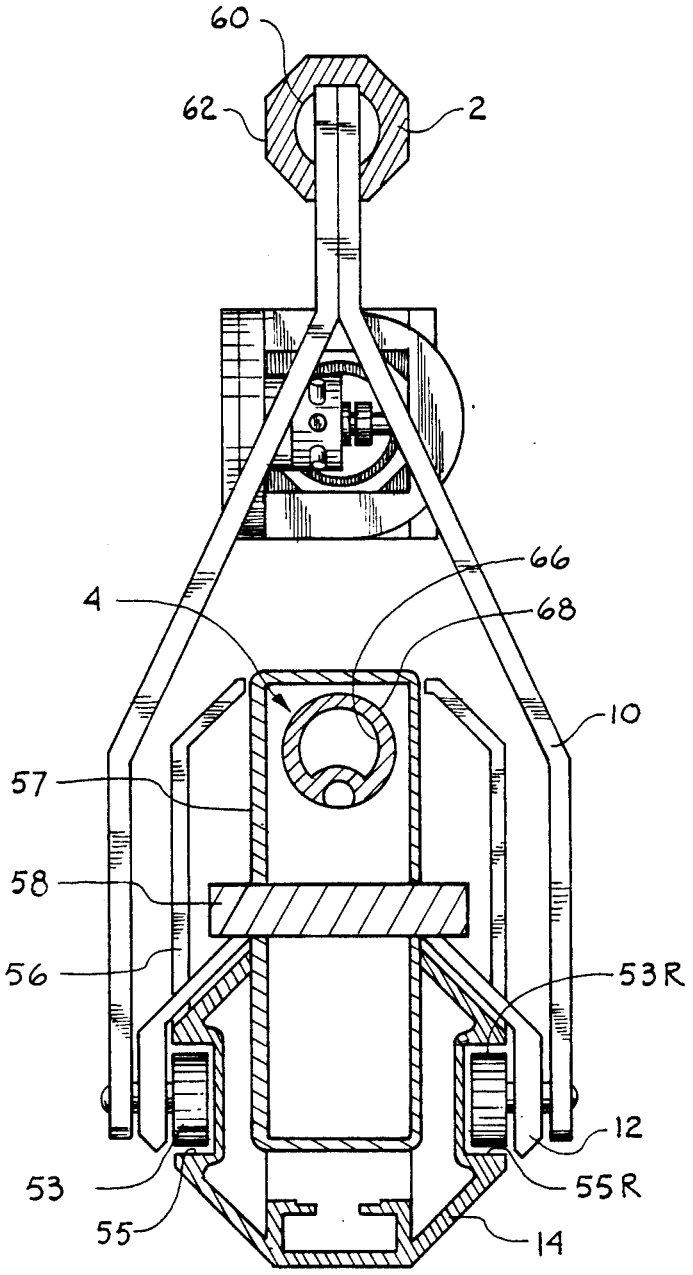
FIGS. 5A–5G are detailed sectional views of various mechanical features of the invention.
Figure 5B:
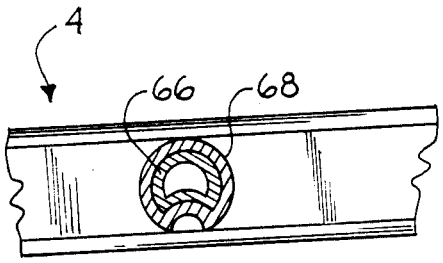

Continuing with reference to the lower portion of FIG. 5A, which is a sectional view of the hip pivot section of the device, this FIGURE also illustrates the outer housing 56 of the hip pivot section, to which the end of the main tube 14 is affixed, and the inner section 57 which rotates inside the outer housing 56 around main axis 58. The thigh support bar 4 terminates in the inner housing 57. The inner and outer housing are provided to allow for rotation of the calf bar inside the hip pivot region with extremely limited clearances between the inner and outer housings, so that the patient's hand or bed clothing or the sheets on the bed do not become caught or bound up in between the inner and outer housing as the thigh support arm rotates within the outer housing 56. A further feature of the hip pivot design is provided to account for the fact that when the thigh support drive arm 4 and calf support drive arm 2 are in their fully-extended positions as illustrated in FIG. 4A, it can be very difficult for the motor and lead screw arrangement to break the knee pivot free.

To aid in raising the thigh support drive arm 4 when it is in its fully horizontal position, which could be a difficult mechanical feat, the hip pivot 8 includes a leaf spring 50 which is mounted on thigh support 4. As the thigh support is lowered toward the drive tube 14, the spring 50 rotates with the thigh support and its end is pressed against a roller 52 fixed to the side of hip pivot housing 56. Thus, energy is stored in the leaf spring as it rotates down, and when the yoke 10 attempts to drive the calf and thigh drive arms back into the flexed position of FIG. 1, the leaf spring 50 will provide additional leverage to drive the thigh support back up away from the main drive tube 14.

Referring next to FIG. 5A, the internal structure of several of the elements is illustrated in an end sectional view. The calf bar 2 appears at the top, and includes both inner and outer sections 60, 62 so that the length of the bar can be adjusted.

Figure 5C:
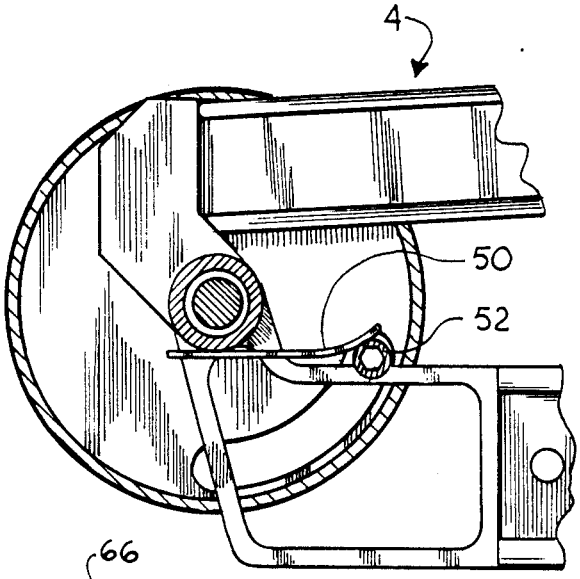
Figure 5D:
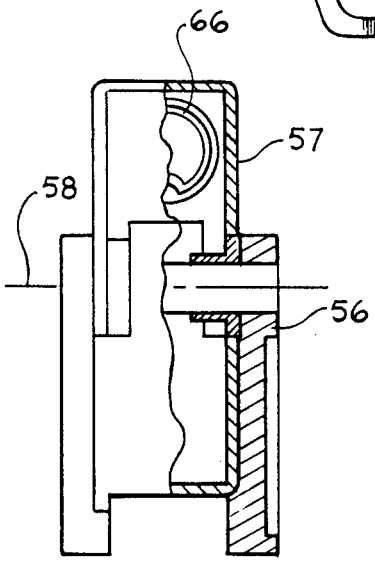

The thigh bar 4 is shown attached to the inner housing 57, and also includes inner and outer sections 66, 68. The octagon-shaped portion 70 of the outer thigh bars is included to prevent twisting of one portion of the thigh bar relative to another. FIG. 5C, which also illustrates an alternative embodiment of the hip pivot region 8 designed to provide a shorter length for the main drive tube, also illustrates the differing outer and inner telescoping sections of the thigh support arm 4. The inner section is circular so that it slides easily within the octagon-shaped outer section 70. FIG. 5D illustrates how the inner housing 57 of this particular embodiment rotates in the outer housing 56 of the hip pivot region on axis 58. This also provides an end view of the inner tubular section 66 of the thigh support arm 4.

Figure 5E:
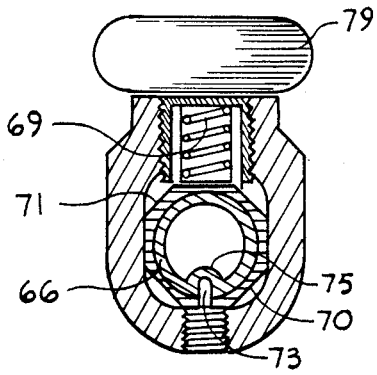
Figure 5F:
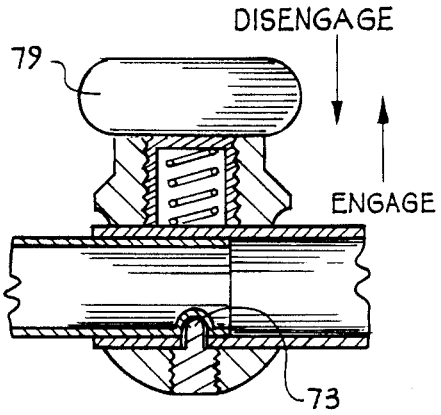
Figure 5G:
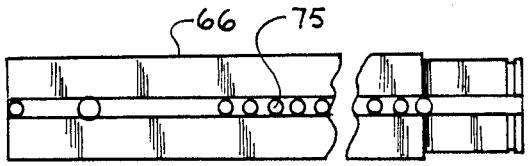

The manner in which the inner tube section 66 slides inside the outer tube section 68, and their relative position is fixed is illustrated in FIGS. 5E, 5F and 5G. The tubes 66, 68 are normally held in place relative to one another by the combination of a spring 69 and pressure bar 71, which presses down against the top of the inner section 66, coordinated with the pin 73 which engages in a series of holes 75 in the bottom surface of the inner tube 66. Thus, when it is desired to change the length of the thigh support by changing the relative position of the inner and outer telescoping sections 66, 68, the knob 79 is rotated lifting the engaging rod 71 up off the inner tube 66. The knob is then pressed down, disengaging the pin from the hole 75. The tubes are then slid to the new positions, and the locking device knob 79 is raised, causing the pin 73 to lock up into the newly selected hole 75. Thus, the two sections are now locked firmly in place, and rotation of the inner telescoping section 66 relative to the outer telescoping octagonal section 68 is prevented by the position of the pin in the hole.

Figure 7A:
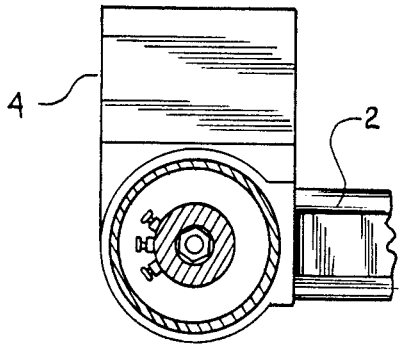
FIGS. 7A and 7B are sectional views of the knee hinge which joins the calf and thigh supports of the present invention; and 25
Figure 7B:
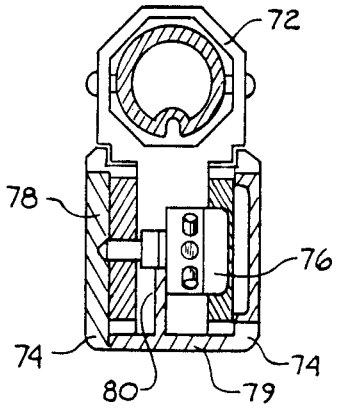

The upper portion of FIG. 4A, together with FIGS. 7A and 7B, illustrates in further detail the knee joint 6. The joint 6 includes an inner and outer clevis 72, 74 so that the calf and thigh bars 4, 2 may pivot easily with respect to one another. The inner pivot is attached to the thigh bar 4, and rotates on bearings 79 relative to the outer clevis being attached to the calf bar. A potentiometer 76 is also provided having one fixed end 78 located within the knee pivot. The other end is attached to the inner clevis as indicated at 80, so that the rotation of the knee can always be measured relative to a fixed reference. The body of the potentiometer is supported from the pin 80 on the inner clevis so that it has some free float within the knee joint 6. In this way, the potentiometer can be located directly within the knee joint to measure the relative movement of the inner and outer clevis, without tying down the body of the potentiometer directly to one side of the joint. Because of the twisting and bending which must necessarily occur in this knee joint, tying down the body of the potentiometer would necessarily result in significant damage to this potentiometer if the movement of both the stem and the body were severely restricted. The necessary cable to the potentiometer can be led in through the thigh support bar.

As was discussed at some length in the background of the invention, it is important to be able to raise the entire device off the hospital bed so that the sheets can be changed or the patient, who may be relatively immobile, can be moved easily onto and off of the bed without the CPM device being in the way. To achieve this goal, the end of the drive tube 14 incorporates a vertical lift assembly 15, shown generally in FIG. 4A and in detail in FIG. 4B. This vertical lift assembly incorporates a standard clamp 90 for clamping the entire CPM device to the traction frame at the end of the hospital bed. Once the CPM device is clamped to the end of the hospital bed using the clamp 90, then the entire CPM device can easily be rotated up off the bed in the direction of arrow 92 (FIG. 3) using the power assist shown in FIGS. 4A and 4B.

Figure 3:
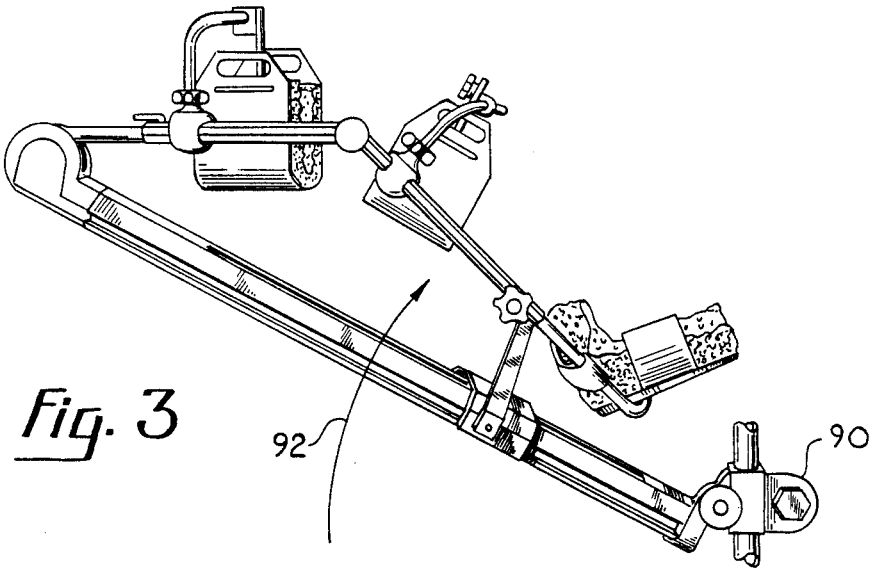
FIG. 3 is a view of the invention in its elevated form.
Figure 6:
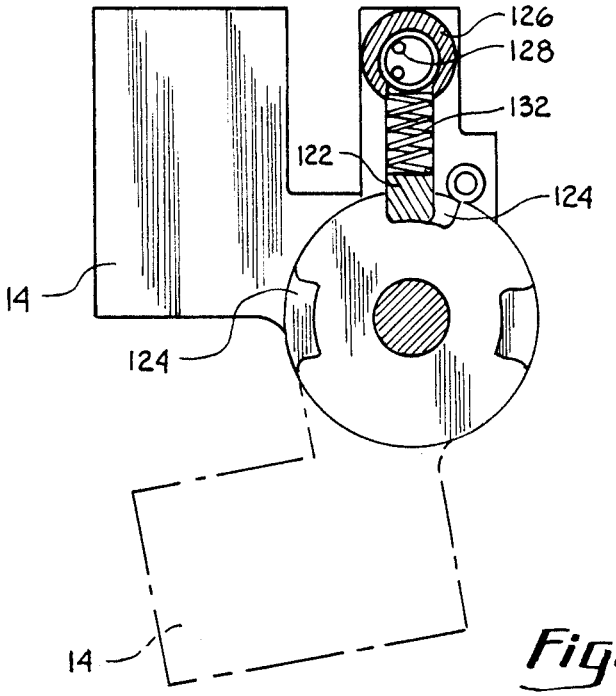
FIG. 6 is a sectional view of a lock for fixing the location of the CPM device on the bed.

Because of the presence of the motor and the like, the CPM device can be heavy to lift out of the way. Means are provided in the vertical lift assembly to aid in the rotation of the CPM device. Specifically, the axis 100 about which the CPM device will rotate includes a spur gear 102 having a plurality of gear teeth which mesh with a rack gear 104 provided inside the tube 106 of the vertical lift assembly and specifically attached to the side of the piston 105 of gas spring 108. As the doctor or nurse lifts the CPM device out of the way, the gear teeth 102 engage gear rack 104, driving the piston 105 of a gas spring assembly 108 down toward the base of the support tube 106. The upper end of the gas spring is fixedly mounted to the top of the tube at 110. When the gas spring 108 is driven far enough, the force exerted by the spring aids in the movement of the rack and the gear, and in fact provides most of the force in the direction of the arrow 112, rotating the CPM device upwardly. When the CPM device is at its full height, as shown in FIG. 3, the gas spring will aid in keeping it at that height, although a lock FIG. 6 is provided adjacent the axis 100. When the CPM device is to be lowered onto the hospital bed, the drive tube 16 is grasped and pulled down toward the bed. The gas spring force is overcome, and the rack 104 with the attached piston 105 of the gas spring will move back up toward the top 110 of the support tube 106. As it does, for at least a portion of the rotation of the CPM device about the axis, the gas spring will provide some resistance, preventing an unnecessarily quick lowering of the CPM device onto the bed.

As a further safety measure and to avoid inadvertent movement of the CPM device relative to the hospital bed, a lock is provided mounted above the wheel which supports the spur gear 102. This lock which may be mounted on the face of the support post 106, which is shown in FIG. 6, comprises a pall 122 which cooperates with recesses 124 spaced around the periphery of the gear wheel 102. When the device is in the horizontal position illustrated in FIG. 4A, then the recess 124 holds the pall 122 to prevent inadvertent upward movement. When it is desired to lift the CPM device off the bed, the knob 126 is rotated clockwise, turning the pin 128 in slot 130 to provide an effective camming action, which converts the rotary motion of the knob to a lifting motion of the pall against the biasing force of spring 132 which normally holds the pall in the recess. With this lifting motion completed, the CPM device indicated by the drive tube 14 can be lifted off the bed and rotated upward. When the drive tube 14 is vertical relative to the bed, the pall is allowed to slip back into the next adjacent recess 124, locking the drive tube and CPM device safely above the hospital bed.

A further advantage of the present invention is illustrated in FIGS. 1 and 2. Because a single drive tube extends from the bed support post 106 to the hip alignment point 8, it is very easy to arrange this CPM device for use with either the left or right leg of a patient. Specifically, to change this device from use with the right leg of a patient as illustrated herein to the left leg of a patient, the two leg support arms 24, 26 are simply rotated 180° about their connection points 122, 124 to drive arms 2, 4. The foot support is also rotated 180°. A new patient kit being used for each patient, new calf and thigh supports as illustrated in FIGS. 2B and 2C, and a foot support as appears in FIG. 1 are provided to hold the patient's foot in place.

Modifications to the preferred embodiment of the present invention may occur to a person of skill in the art who studies the present invention disclosure. Therefore, the scope of the present invention is to be limited only by the following claims.

What is claimed is:

1. A continuous passive motion device for articulating the knee of a patient's leg, comprising:

a drive tube having a mounting means reciprocally mounted along said drive tube wherein said mounting means includes opposing leg members on opposite sides of said drive tube;

a thigh support bar pivotally connected to one end of said drive tube;

a calf support bar having one end pivotally connected to said thigh support bar, and having another end connected to said mounting means;

drive means coupled to said drive tube for reciprocally driving said mounting means along said tube to cylically raise and lower said thigh and calf support bars; and a support saddle connected to each said support bar, each said support saddle including a rigid frame and a soft central portion removably attached to said rigid frame, in which said soft central portion of each saddle lifts up the thigh and calf of the patient's leg, respectively, when said thigh and calf support bars are being raised by said drive means, and in which said rigid frame pushes down on the top of said thigh and calf when said thigh and calf support bars are lowered by said drive means.

2. A continuous passive motion device for articulating the knee of a patient's leg as recited in claim 1 wherein said rigid frame comprises a T-shaped metal frame.

3. A continuous passive motion device for articulating the knee of a patient's leg as recited in claim 2 wherein said soft central portion comprises a flexible support element detachably coupled at each end thereof to a handle which can be used to lift said patient's leg up to said metal frame.

4. A continuous passive motion device for articulating the knee of a patient's leg as recited in claim 3 further comprising means for attaching said soft central portion and said handles to said T-shaped metal frame.

5. A continuous passive motion device for articulating the knee of a patient's leg as recited in the claim 1 wherein said support saddle includes an L-shaped support bar connecting said support saddle to said support bar, in rotatable fashion.

6. A continuous passive motion device for articulating the knee of a patient's leg as recited in claim 5 wherein said support saddle includes a vertical adjusting element for adjusting the height of said support saddle with respect to said L-shaped support bar.

7. A continuous passive motion device for articulating the knee of a patient's leg as recited in claim 1 wherein said thigh support bar comprises an inner tube section telescopically slidable within an outer tube section for adjusting the length of said thigh support bar.

8. A continuous passive motion device for articulating the knee of a patient's leg as recited in claim 7 further comprising means operably coupled to said thigh support and said drive tube for biasing said thigh support bar upward.

9. A continuous passive motion device for articulating the knee of a patient's leg, comprising:

a single drive tube having a mounting means reciprocally mounted along said drive tube;

a thigh support bar pivotally connected to said drive tube wherein said mounting means includes opposing leg members on opposite sides of said drive tube;

a calf support bar having one end pivotally connected to said thigh support bar, and having another end connected to said mounting means;

drive means coupled to said drive tube for reciprocally driving said mounting means along said tube to cyclically raise and lower said thigh and calf support bars;

a support saddle suspended from each said support bar, for supporting the thigh and calf, respectively, of said patient's leg; and means for pivotally connecting one end of said drive tube to a stationary frame member of a bed, said drive tube being movable between an upright position wherein said drive tube is elevated to an inclined position off of said bed, and a down position wherein said drive tube is lowered to a substantially horizontal position onto said bed.

10. A continuous passive motion device for articulating the knee of a patient's leg as recited in claim 9 further comprising biasing means coupled to said pivoting means for providing forces to urge said drive tube upward toward elevated position.

11. A continuous passive motion device for articulating the knee of a patient's leg as recited in claim 10 wherein said pivoting means includes stop means for maintaining said drive tube in a substantially upright position.

12. A continuous passive motion device for articulating the knee of a patient's leg as recited in claim 11 wherein said pivoting means further comprises stop means for maintaining said drive tube in a substantially horizontal orientation.

13. A continuous passive motion device for articulating the knee of a patient's leg as recited in claim 12 wherein said biasing means includes a spur gear rigidly connected to one end of said drive tube, and a rack gear engageable with said spur gear, said rack gear being associated with a gas spring for biasing said rack gear in a direction to provide upward forces on said drive tube.

14. A continuous passive motion for articulating the knee of a patient's leg as recited in claim 13 wherein said means for pivotally connecting said drive tube to said stationary member comprises an adjustable clamp.

15. A continuous passive motion device for articulating the knee of a patient, comprising:

a single drive tube;

a thigh support bar hingedly connected to said drive tube to establish a hip pivot;

a calf support bar hingedly connected to said thigh support bar to establish a knee pivot;

a mounting means connected to said calf support bar and reciprocally movable along said drive tube between a first position wherein said thigh support and calf support bar are in substantially linear alignment, and a second position wherein said thigh support bar and calf support bar form an angle; wherein said mounting means includes opposing leg members on opposite sides of said drive tubes; and a support saddle connected to each said support bar, each said support saddle including a soft central portion for supporting the thigh and calf, respectively, of the patient's leg, and including a rigid frame portion for pushing down on the top of said thigh and calf to extend said patient's leg when said thigh support bar and calf support bar are in said aligned substantially linear alignment.

16. A continuous passive motion device for articulating the knee of a patient as recited in claim 15 further comprising means coupled to said drive tube for pivotally connecting one end of said drive tube to a stationary member of a bed so that said drive tube is movable between an up position wherein said drive tube is elevated to an inclined position, and a down position wherein said drive tube is lowered to a substantially horizontal position.

17. A continuous passive motion device for articulating the knee of a patient as recited in claim 16 wherein said saddle comprises a T-shaped metal frame connected to said support bar, and said soft central portion comprises detachably removable strip of material made of lamb's wool.

18. A continuous passive motion device for articulating the knee of a patient as recited in claim 16, wherein said hip pivot includes means for biasing said thigh support bar upward.

19. A continuous passive motion device for articulating the knee of a patient as recited in claim 16 wherein said means for pivotally connecting said drive tube to a stationary member includes biasing means for urging said drive tube toward said elevated position.

20. A continuous passive motion device for articulating the knee of a patient as recited in claim 16 wherein said means for pivotally connecting one end of said drive tube to a stationary member comprises first stop means for maintaining said drive tube in a substantially upright position, and second stop means for maintaining said drive tube in a substantially horizontal position.

* * * * *